United States Patent [19]

Furey

[11] Patent Number: 4,924,893

[45] Date of Patent: May 15, 1990

[54] BEACH UMBRELLA SAFETY SYSTEM

[76] Inventor: Charles Furey, 633 Wyoming Dr., Toms River, N.J. 08753

[21] Appl. No.: 227,795

[22] Filed: Aug. 3, 1988

[51] Int. Cl.[5] ..... A45B 3/00; A45B 5/00

[52] U.S. Cl. ..... 133/16; 70/59; 248/551

[58] Field of Search ..... 135/20 R, 21, 16; 70/59, 58, 62, 14–18; 248/551, 552, 553, DIG. 10

[56] References Cited

U.S. PATENT DOCUMENTS

| | | | |
|---|---|---|---|
| 486,256 | 11/1892 | Leehey | 70/58 |
| 1,293,526 | 2/1919 | Overin | 135/20 R |
| 1,460,821 | 7/1923 | Morris | 125/20 R |
| 2,024,946 | 12/1935 | Morgenstern | 135/20 R |
| 2,126,030 | 8/1938 | Peterson | 248/499 |
| 2,551,963 | 5/1951 | Myers | 135/20 R |
| 3,407,825 | 10/1968 | Doyle | 135/20 R |
| 4,118,902 | 10/1978 | Saxton | 248/551 |
| 4,546,730 | 10/1985 | Holland | 119/117 |
| 4,570,465 | 2/1986 | Bennett | 70/18 |
| 4,648,482 | 3/1987 | Kitson | 182/108 |
| 4,733,840 | 3/1988 | D'Amore | 70/18 |

FOREIGN PATENT DOCUMENTS

| | | | |
|---|---|---|---|
| 1557379 | 3/1970 | Fed. Rep. of Germany | 135/20 R |
| 935733 | 6/1938 | France | 135/20 R |
| 1080061 | 8/1967 | United Kingdom | 135/20 R |

*Primary Examiner*—Henry E. Raduazo
*Attorney, Agent, or Firm*—Sherman and Shalloway

[57] ABSTRACT

A beach umbrella anchoring system comprises an anchor member comprising a container, in the form of a beach bag, for containing a weighting medium, such as sand, and a connector for connecting the container to a beach umbrella restraining device; and a beach umbrella restraining device comprising a flexible cable member, a releasable connector fixed to one end of the cable for releasably connecting the cable to a beach umbrella, a second releasable connector, fixed to the other end of the cable, for releasably connecting the cable member to the connector of the anchor member, and a third releasable connector, slidingly attached to the cable member intermediate the ends thereof for releasably attaching the cable member to the beach umbrella. The anchoring system may be supplied in the form of a kit comprising the anchoring member (beach bag) the restraining device, and a sand shovel for filling the container member with sand. The provision of the container member in the form of a beach bag allows the system to be readily carried to the beach along with other paraphernalia. The system serves to anchor beach umbrellas against being overturned and flailing about in sudden or unexpected gusts of wind.

27 Claims, 5 Drawing Sheets

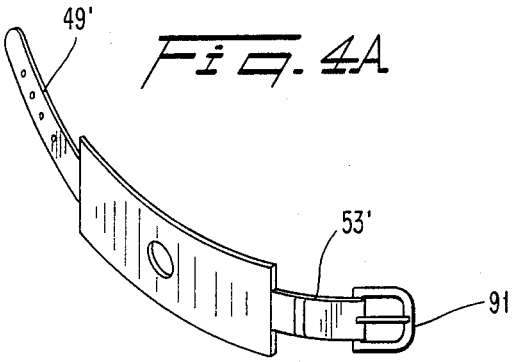
Fig. 4A
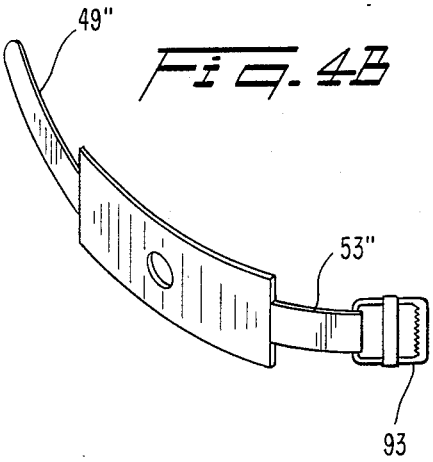
Fig. 4B
Fig. 4C
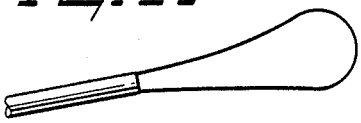
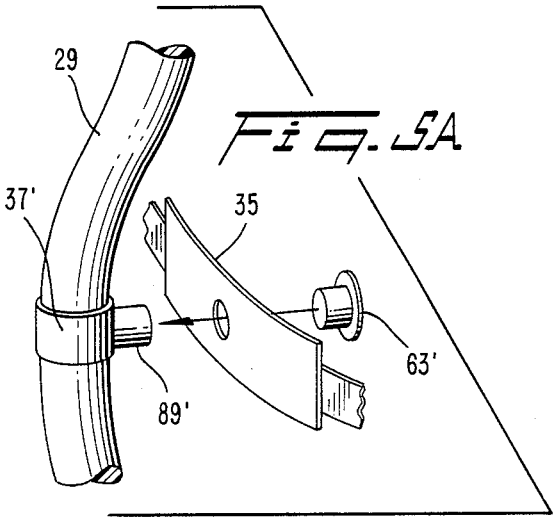
Fig. 5A
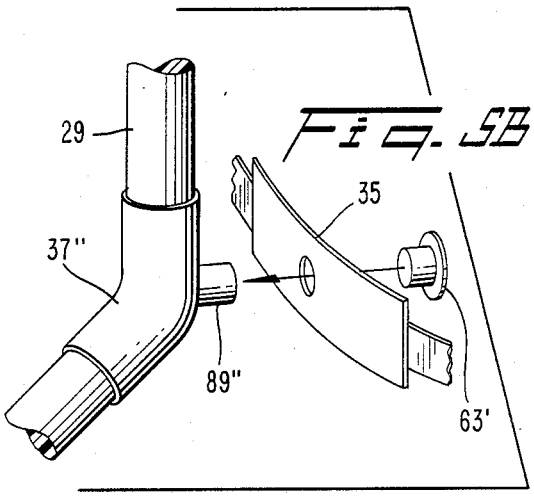
Fig. 5B
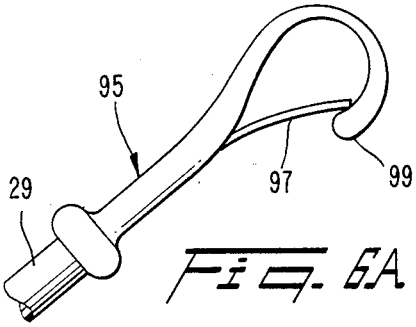
Fig. 6A
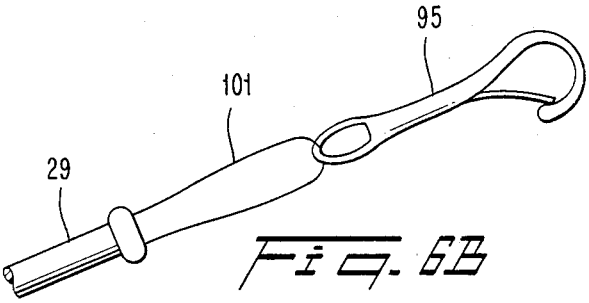
Fig. 6B Fig. 7A
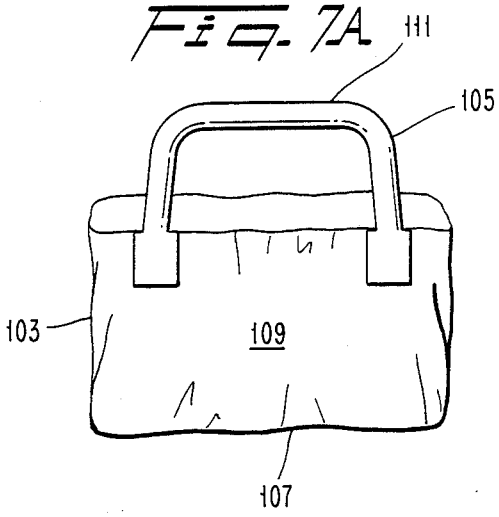
Fig. 7B
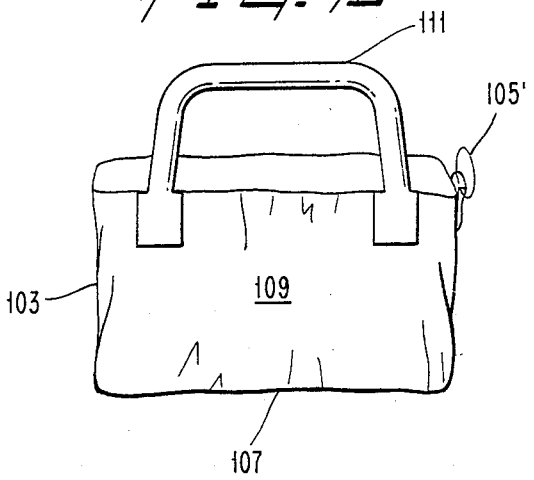
Fig. 7C
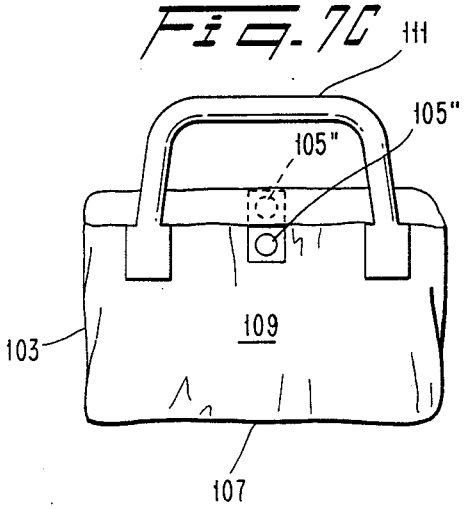
Fig. 7D
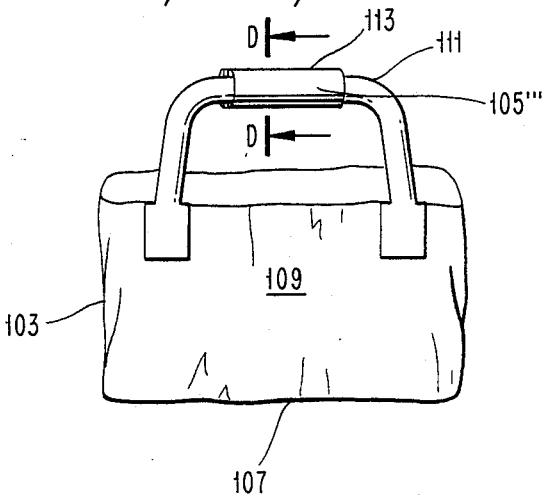
Fig. 8
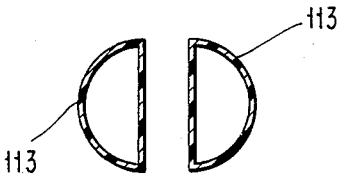
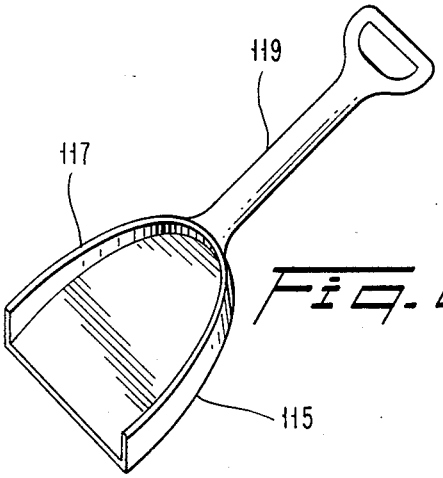
Fig. 9

BEACH UMBRELLA SAFETY SYSTEM

BACKGROUND OF THE INVENTION

1. Field Of The Invention:

The present invention is directed to the provision of a beach umbrella safety device. More particularly, the present invention is directed to the provision of a restraining device for preventing beach umbrellas from being blown about by unexpected sudden gusts of wind. More particularly, the present invention provides a beach umbrella restraining device, an anchoring system utilizing the restraining device and a kit containing the components of the anchoring system.

2. Description Of The Prior Art:

Many attempts have been made to provide stable portable shelters, particularly for recreational use such as during camping or bathing. For example, U.S. Pat. No. 998,093, to Hill, discloses a portable tent comprising a three-sided canvas cover adapted to be stretched around a tripod of legs depending from a frame. Canvas bags, adapted to contain a weighting material, such as sand or gravel, are adapted to be connected to the legs so as to hold the legs rigid thereby securely anchoring the tent.

U.S. Pat. No. 1,409,316, to Smith, discloses a bathing tent comprising a central pole adapted to have its lower end embedded in the sand or the ground and to have its upper end engage the central portion of the wall of the tent. The lower end or ends of the wall or walls of the tent are provided with a pocket or pockets to receive sand or other heavy material to anchor the lower ends upon the ground. The upper portion of the tent may be provided with a device for holding the walls away from the central pole a sufficient distance to provide ample room for the occupant or occupants.

U.S. Pat. No. 1,498,111, to Nelsen, discloses a tent for camping wherein the lower end of the central pole is fitted with an auger blade so as to allow easy and firm installation of the central pole. The bottom edges of the walls of the tent are provided with pockets adapted to be filled with earth or sand, the weight of which is designed to hold the wall in place without additional fastenings.

U.S. Pat. No. 1,650,111, to Byne, discloses a tent-like shelter comprised of a plurality of ribs which are joined to one another at their ends. The respective groups of ends of the ribs are connected by a tensioning device which imparts a bow to the ribs. The ribs support a fabric body. The tent may be in the form of a quadrant of a sphere with one end resting against the ground and the other end maintained in a vertical position by the utilization of guy lines attached to an anchor which may comprise a bag filled with a suitable ballast material.

U.S. Pat. No. 2,036,033, to Fisher, discloses a portable canopy and beach shelter construction comprising a plurality of elongated U-shaped frame members capable of being compactly collapsed together, when the canopy is folded, the adjacent ends of the U-shaped members being hingedly interconnected. Pegs which may be inserted into the ground are attached to these hinges. A covering made of a textile interconnects the various U-shaped members. The floor and/or cover of the canopy is formed by a mat attached to one terminal U-shaped frame member and this mat is provided with pockets adapted to be filled with sand, earth or other materials for the purpose of stabilizing the entire structure and permitting it to resist wind and distorting influences.

U.S. Pat. No. 3,070,107, to Beatty, discloses a shelter apparatus comprising a generally cylindrical post unit adapted to be erected with one end anchored in the ground. A tubular adaptor is fixed at right angles to the other end of the post unit with the adaptor projecting from opposite sides of the post unit. Support arms are telescopically mounted to either end of the adaptor and biased inwardly toward the post unit so that they will normally form a T-type structure with the post unit, however, when collapsed, the support arms may be folded parallel to the post unit. The support arms support a flexible sheet at one end of the sheet and the free end of the sheet may be anchored by means of pegs and/or ballast bags.

U.S. Pat. No. 3,226,737, to Rote, discloses a beach and picnic blanket comprising a generally rectangular shaped flexible material, with wide-open triangular shaped corner pockets at each corner point about the perimeter of the flexible material. The corner pockets may receive weighted materials therein to anchor the blanket.

U.S. Pat. No. 3,333,595, to Bannister et al., discloses a cabana having a floor, a top and a connecting sidewall structure. A hollow, inflatable, stretching and anchoring rim is connected to the floor around the margin thereof. The hollow anchoring rim is constructed so as to hold water as ballast or to be inflated and to receive sand between the rim and the sidewall structure to fully extend the floor and tighten the sidewall structure for maximum room inside the cabana and to provide ballast.

Despite these attempts to provide portable shelters for recreational use, the fact remains that the most ubiquitous form of portable shelter is the beach umbrella. Typically, such beach umbrellas are provided with a support shaft having a tapered end so as to facilitate insertion of the shaft into the sand of the beach to provide the sole support for the umbrella. Unfortunately, these beach umbrellas are liable to be up-ended by sudden and unexpected gusts of wind and the tapered end of the support shaft then becomes a dangerous, and potentially lethal hazard to the users of the umbrella and other people on the beach.

SUMMARY OF THE INVENTION

Accordingly, it is one object of the present invention to provide a beach umbrella restraining device whereby the beach umbrella may be prevented from blowing about if up-ended by a sudden and unexpected gust of wind.

It is a further object of the present invention to provide a beach umbrella anchoring system whereby the beach umbrella may be conveniently tied to a sufficient weight so as to prevent its being blown about as a result of sudden or unexpected gusts of wind.

It is a still further object of the present invention to provide a kit whereby the necessary apparatus and materials for anchoring the beach umbrella may be conveniently carried to and from the beach.

As will become more readily apparent hereinafter, these objects of the invention and others that will become apparent, may be attained by the provision of a beach umbrella restraining device comprising a flexible, longitudinally extending cable member, the cable member having a first end and a second end; first releasable attachment means, fixed to the first end of the cable, for releasably attaching the cable member to a beach umbrella; second releasable attachment means, fixed to the second end of the cable, for releasably attaching the cable member to an anchor member; third releasable attachment means, attached to the cable member intermediate the first and second ends, for releasably attaching the cable member to the beach umbrella.

In a particularly preferred embodiment of the restraining device, the third releasable attachment means is adjustably attached to the cable member for movement along the cable intermediate the first and second ends.

In a further aspect of the invention, there is provided a beach umbrella anchoring system comprising (A) an anchor member comprising a container means for receivably containing a weighting medium, and connection means, attached to the container means, for connecting the container means to a beach umbrella restraining device; and (B) a beach umbrella restraining device comprising a flexible, longitudinally extending cable member, the cable member having a first end and a second end, first releasable attachment means, fixed to the first end of the cable, for releasably attaching the cable member to a beach umbrella, and second releasable attachment means, fixed to the second end of the cable, for releasably attaching the cable member to the connection means of the anchor member. In a particularly preferred embodiment of the anchoring system, the restraining device further comprises third releasable attachment means, attached to the cable member intermediate the first and second ends, for releasably attaching the cable member to the beach umbrella.

In a still further aspect of the present invention, there is provided a beach umbrella anchor kit comprising (A) an anchor member comprising a container means for receivably containing a predetermined mass of sand, and connection means, attached to the container means, for connecting the container means to a beach umbrella restraining device; (B) a beach umbrella restraining device comprising a flexible, longitudinally extending cable member, the cable member having a first end and a second end, first releasable attachment means, fixed to the first end of the cable, for releasably attaching the cable member to a beach umbrella, and second releasable attachment means, fixed to the second end of the cable, for releasably attaching the cable member to the connection means of the anchor member; and (C) a sand shovel.

In a particularly preferred embodiment of the anchor kit, the restraining device further comprises third releasable attaching means, attached to the cable member intermediate the first and second ends, for releasably attaching the cable member to the beach umbrella.

BRIEF DESCRIPTION OF THE DRAWING FIGURES

FIGS. 4A, 4B, and 4C disclose alternative forms of releasable attachment devices for connection of the restraining device to a beach umbrella.

FIGS. 5A and 5B, disclose alternative structures for adjustable attachment of a releasable attachment device to the cable member of the restraining device.

FIGS. 6A and 6B disclose alternative structures for a releasable attachment connection to the anchor member of the anchoring system.

FIGS. 7A, 7B, 7C, and 7D illustrate different structures for connecting the anchor member of the anchoring system to the restraining device.

FIG. 8 is a cross sectional view taken along line D—D of FIG. 7D.

FIG. 9 illustrates a sand shovel utilizable in the kit contemplated by the presently claimed invention.

DETAILED DESCRIPTION OF THE INVENTION

Figure 1:
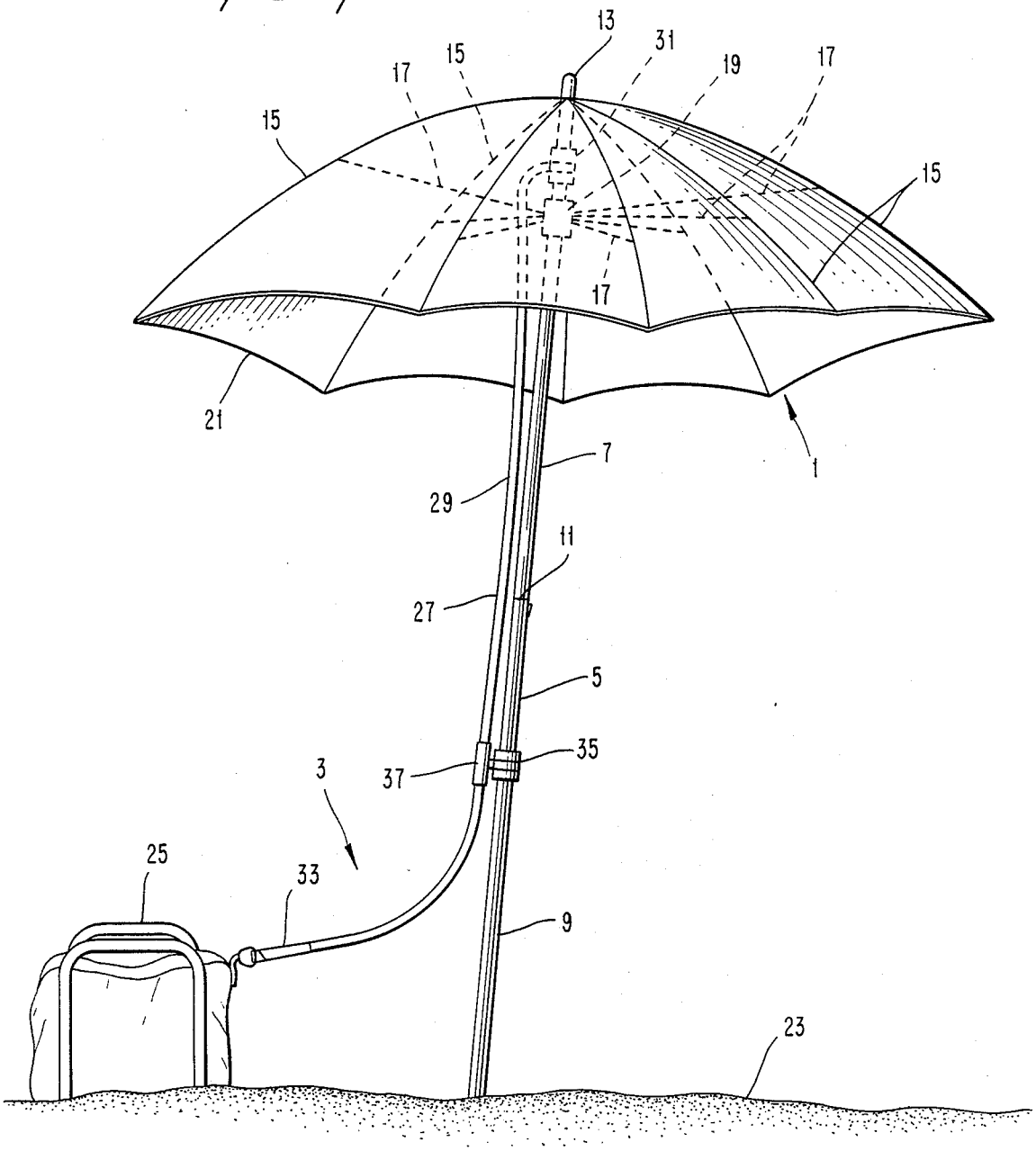
FIG. 1 is an illustration of the anchoring system of the present invention attached to a beach umbrella.

FIG. 1 illustrates a beach umbrella, generally indicated at 1, and the anchoring system, generally indicated at 3, of the present invention. In particular, the beach umbrella comprises a support shaft 5 which may be formed of an upper section 7 and a lower section 9, which may be interconnected through joint 11 so as to allow disassembly and ease of transportation.

The upper section 7 at its upper end 13 has a plurality of ribs 15 pivotally connected thereto. A corresponding strut 17 is pivotally connected to each rib 15 and all of the struts 17 upper section 7 of the support shaft 5. The slider 19 may be releasably locked in an upper position, as shown in FIG. 1, whereby the ribs 15 are extended in a radial manner from the support shaft 5. A fabric cover 21 is supported by the ribs 15.

The lower section 9 of the support shaft 5 has a sharply tapered lower end (not shown) so as to allow easy penetration of the ground 23 so that the support shaft 5 may be inserted into the ground to provide a relatively stable structure.

Nonetheless, unexpected gusts of wind or gusts of wind of greater force than expected, may cause the umbrella 1 to topple or, even more dangerously, allow the umbrella to topple with the tapered end of the support shaft 5 flailing about.

In order to prevent this state of affairs, the umbrella 1, as shown in FIG. 1, is fitted with the anchoring system 3 comprising an anchor member 25 and a restraining device 27.

The restraining device 27 comprises a flexible cable member 29 which may be formed of a steel cable, a plastic-coated steel cable, rope, or cord, etc. Preferably, the cable member is formed of a vinyl polymer, nylon or polyurethane cord. Most preferably, the cable member is formed of polyurethane cord. A releasable connector 31 is attached to one end of the cable member 29, the releasable connector 31 being adapted to releasably attach the cable member 29 to the support shaft 5 of the beach umbrella. A second releasable connector 33 is fixed to the other end of the cable member 29 and is adapted to releasably attach the cable member to the anchor member 25. Preferably, a third releasable connector 35 is attached to the cable member 29 intermediate the two ends of the cable, this third releasable connector 35 is also adapted to releasably attach the cable member to the support shaft 5 of the beach umbrella 1. Most preferably, the third releasable connector 35 is connected to a slide, slidably mounted on cable member 29, so as to allow adjustment of the connector 35 to any position intermediate the two ends of the cable member.

Figure 2:
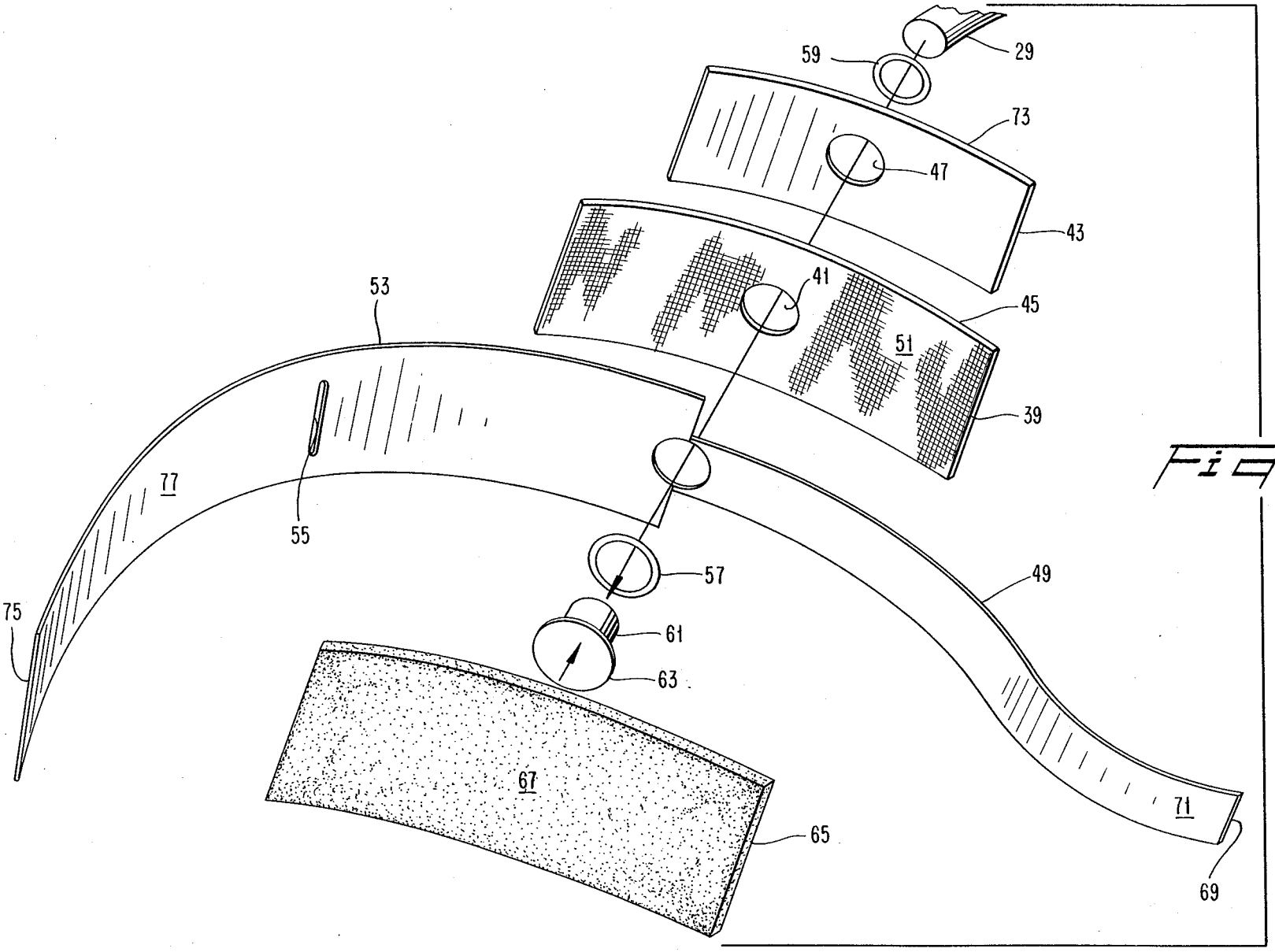
FIG. 2 is an exploded view of one end of the restraining device according to the present invention showing details of the construction of a releasable attachment for connection to the beach umbrella.

Turning now to FIG. 2, there is illustrated a preferred form of the releasable connector 31. The releasable connector comprises a reinforcement strap 39 comprising, e.g., polypropylene webbing or other suitable fabric, which has a bore 41 therethrough. A locking pad 43 is attached to one side 45 of the reinforcement strap 39, preferably by stitching, however, any conventional means of connection, e.g. gluing, melt bonding, etc. may be utilized. The locking pad 43 has a bore 47 formed therethrough, which aligns with the bore 41 in reinforcement strap 39. A first locking strap 49 is similarly affixed to the other side 51 of reinforcement strap 39. A second locking strap 53 is also similarly affixed to the other side 51 of reinforcement strap 39. The second locking strap 53 is of greater width than the first locking strap 49 and has a slit 55 formed therein through which the first locking strap may be passed. Grommets 57 and 59 are disposed on opposite sides of the assembly at the periphery of the bores 41 and 47 through reinforcement strap 39 and locking pad 43, respectively. The end of cable member 29 passes through the grommets and the bores and is received in the hollow end 61 of plug 63. The end of cable member 29 is sealed into the hollow end of plug 63 as by gluing, etc., whereby plug 63 holds the assembly of the reinforcement strap 39, the locking pad 43, the first locking strap 49 and the second locking strap 53 onto cable member 29. A friction pad 65 is then affixed to the side 51 of reinforcement strap 39 by any of the previously noted techniques. Friction pad 65 has a surface 67 which may be naturally rough or tacky, or artificially roughened or treated to obtain a high coefficient of friction, so that when it engages the surface of the support shaft 5 of umbrella 1, it will prevent slippage along the shaft of the umbrella. Neoprene rubber has been found to have satisfactory properties in this regard.

It should be noted that locking pad 43, and locking straps 49 and 53, constitute elements of a hook-and-loop locking system (e.g., Velcro®). More particularly, surface 67 of friction pad 65 will be brought into contact with the surface of support shaft 5 of umbrella 1. Locking strap 49 will then be wrapped around the shaft 5 of the umbrella and the free end 69 of locking strap 49 will be passed through slit 55 formed in locking strap 53. Locking strap 49 will be snugged tightly against the support shaft 5 of the beach umbrella and then the surface 71 of the free end 69 will be brought into contact with the surface 73 of locking pad 43, whereby the strap 49 will be releasably adhered to the locking pad 43. In a similar manner, the free end 75 of locking strap 53 will be snugged about the support shaft 5 of the beach umbrella 1 and the surface 77 of the free end of locking strap 53 will also be brought into contact with surface 73 of locking pad 43, albeit only on those portions of surface 73 not covered by strap 49. Thus, strap 53 will also be releasably adhered to locking pad 43.

Figure 3:
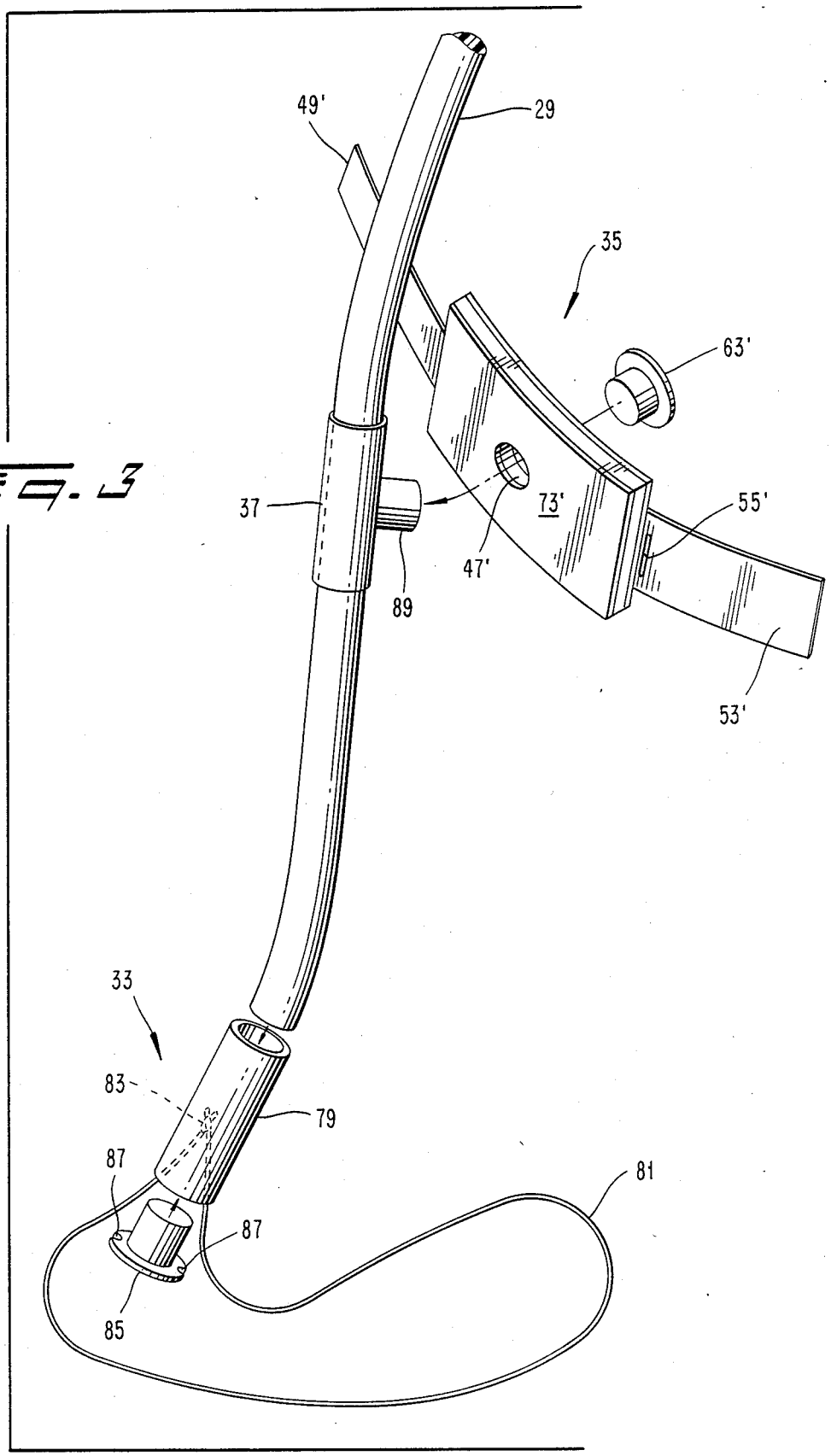
FIG. 3 is an exploded view of the other end of the restraining device according to the present invention showing details of another releasable attachment for connection to an anchor member and a releasable attachment for connection to the beach umbrella which is adjustably attached to the cable member of the restraining device.

FIG. 3 illustrates the other end of cable member 29. In this embodiment, the end of cable member 29 is received within a hollow fitting 79 and sealed therein. A cord 81, such as a nylon cord, may be formed into a loop and one end 83 of the loop may be inserted into the hollow fitting 79. A plug 85 may then be sealed into the end of the hollow fitting 79 so as to trap the end 83 of the loop therein. The plug 85 may have a pair of notches 87, 87 cut therein so as to avoid unnecessary wear on the cord 81 of the loop.

As previously noted, a slide 37 in the form of a hollow tee may be slidably disposed over the cable member 29. The slide 37 has a leg 89 extending therefrom which may be received in the bore 47′ formed through the third releasable connector 35, which may be formed in the same manner as the releasable connector illustrated in FIG. 2 (like parts being similarly numbered). A plug 63′ may pass through the bore 47′ and be received within the arm 89 and sealed therein so as to fix the releasable connector 35 to the slide 37.

FIGS. 4A and 4B illustrate alternative embodiments of the first releasable connector 31 wherein the first locking strap 49 and the second locking strap 53 have been replaced by a notched strap 49′ and a strap 53′ having a buckle 91 affixed thereto; or wherein the first locking strap 49 has been replaced with a belt strap 49″ and the second locking strap 53 has been replaced with a belt 53″ having a slip buckle 93 attached thereto.

The releasable connectors illustrated in FIGS. 4A and 4B may also be utilized in lieu of the third releasable connector 35.

FIG. 4C illustrates a loop, substantially equivalent to the loop illustrated in FIG. 3, which may also be utilized as the first releasable connector.

FIGS. 5A and 5B illustrate alternative techniques for slidably connecting the third releasable connector 35 to cable member 29. In particular, FIG. 5A substitutes a ring tee 37′ for the tee illustrated in FIG. 3. Likewise, FIG. 5B substitutes a 45° tee 37″ for the tee connector illustrated in FIG. 3.

FIGS. 6A and 6B illustrate alternative embodiments of the second releasable connector 33 wherein FIG. 6A illustrates a safety hook 95 wherein the hook opening is closed by a resilient member 97 so as to allow the hook to be readily engaged but to resist disengagement of the hook. In other words, when the hook is being engaged with an object, the resilient member 97 may be pressed inwardly to allow engagement of the hook, however, once the hook is engaged, the resilient member 97 will be pressed against the end 99 of the hook by any pressure tending to disengage the hook. In a similar manner, FIG. 6B illustrates a hook as illustrated in FIG. 6A, however, the hook is connected to cable member 29 via a loop 101.

FIGS. 7A, 7B, 7C and 7D illustrate an anchor member for utilization in the present anchoring system which comprises a container for receiving a weighting medium, generally indicated at 103 and a connection, indicated at 105, 105′, 105″ and 105‴, respectively. The anchor member comprises a substantially planar base member 107 and at least one upstanding peripheral wall 109 which is in contact with the periphery of the base member and attached thereto. The base member and the at least one upstanding peripheral wall cooperate to form an open ended container, which when fitted with handles 111 at the upper edge thereof provides the form of a conventional beach bag. Such a beach bag, when filled with sand, will provide a suitable anchor for the anchoring system of the present invention. In this regard, it should be noted that one cubic foot of sand weighs between about 90 and 110 pounds. Thus, a beach bag of one or two cubic foot capacity should be adequate to provide anchoring for even the largest umbrellas.

With respect to FIG. 7A, the third releasable connector of the restraining device 27 may be engaged with the handles 111 of the beach bag. Alternatively, as illustrated in FIG. 7B, a reinforced ring or loop 105′ may be affixed to the peripheral wall 109 of the beach bag. As a further alternative, as illustrated in FIG. 7C, reenforced grommets 105" affixed in more than one location of the peripheral wall 109 may be used as the point of connection for the restraining device 27. In a still further embodiment, as illustrated in FIG. 7D, matching semicircular handle grips 113, as best seen in FIG. 8, may be formed about the handles 111 and provide a location for attachment of the releasable connector 33 of the restraining device 27.

Finally, FIG. 9 illustrates a sand shovel 115 which may be provided along with the restraining device 27 and the anchoring member 25 (beach bag) so as to allow easy filling of the beach bag with sand as a weighting medium (ballast). The shovel 115 may comprise a blade portion 117 and a handle portion 119 which may be detachably connected to the blade portion 117 for ease of storage and transportation. In this regard, it should also be noted that it is also within the scope of the present invention to provide a beach pail along with the anchoring member, the restraining device and the sand shovel, all of which components may be readily carried in the anchoring member when it is empty of sand.

While the present invention has been illustrated with the utilization of a particular anchoring member, the restraining device 27 will operate when connected to any suitable weighty item, such as an ice chest, which is commonly found at the beach. It is also possible to connect the restraining device to a beach chair, however, it should be borne in mind that the beach chair will generally be only sufficiently weighty to act as an anchoring member when it is actually occupied by an adult.

The cable member 29 is preferably of a length slightly greater than the length of the support shaft 5 of the beach umbrella, whereby the releasable connector 31 may be attached to the shaft 5 at a position near the top of the umbrella and the releasable connector 35 may be attached to the shaft 5 at a position near the bottom of the support shaft 5 and the anchoring member will be located in close proximity to the base of the shaft 5. By this technique, the flailing about of the shaft 5 upon overturn of the beach umbrella will be minimized. By providing releasable connector 35 as being adjustable in position along the cable member 29, varying sizes of umbrellas may be accommodated by a single length of cable member 29.

What is claimed is:

1. A beach umbrella restraining device comprising:

a flexible, longitudinally extending cable member, said cable member having a first end and a second end;

first releasable attachment means, fixed to said first end of said cable, for releasably attaching said cable to a beach umbrella, said first releasable attachment means being connectably engageable of a beach umbrella support shaft, wherein said first releasable attachment means comprises: a pair of straps, each of said straps being connected to said cable member, said straps being adapted to wrap around said beach umbrella support shaft; and connection means for releasably locking said straps to one another;

second releasable attachment means, fixed to said second end of said cable, for releasably attaching said cable member to an anchor member;

third releasable attachment means, attached to said cable member intermediate said first and second ends, for releasably attaching said cable member to said beach umbrella.

2. The restraining device according to claim 1, wherein said first releasable attachment means further comprises friction means, connected to said cable member and disposed intermediate said straps and said beach umbrella support shaft when said straps are wrapped around said beach umbrella support shaft, for preventing said first releasable attachment means from sliding along said beach umbrella support shaft.

3. A beach umbrella restraining device comprising:

a flexible, longitudinally extending cable member, said cable member having a first end and a second end;

first releasable attachment means, fixed to said first end of said cable, for releasably attaching said cable member to a beach umbrella, said first releasable attachment means being connectably engageable of a beach umbrella support shaft;

second releasable attachment means, fixed to said second end of said cable, for releasably attaching said cable member to an anchor member;

third releasable attachment means, attached to said cable member intermediate said first and second ends, for releasably attaching said cable member to said beach umbrella, said third releasable attachment means being connectably engageable of said beach umbrella support shaft at a position longitudinally removed from the position of said first releasable attachment means, relative to said cable member, wherein said third releasable attachment means comprises: a pair of straps, said pair of straps being adjustably connected to said cable member for movement along said cable member intermediate said first and second ends, said pair of straps being adapted to wrap around said beach umbrella support shaft; and connection means for releasably locking said straps to one another.

4. The restraining device according to claim 3, wherein said third releasable attachment means further comprises friction means, adjustably connected to said cable member for movement along said cable member intermediate said first and second ends and disposed intermediate said pair of straps and said beach umbrella support shaft when said pair of straps are wrapped around said beach umbrella support shaft, for preventing said third releasable attachment means from sliding along said beach umbrella support shaft.

5. A beach umbrella anchoring system comprising:

(A) an anchor member comprising:

a container means for receivably containing a weighting medium, and connection means, attached to said container means, for connecting said container means to a beach umbrella restraining device; and (B) a beach umbrella restraining device comprising:

a flexible, longitudinally extending cable member, said cable member having a first end and a second end, first releasable attachment means, fixed to said first end of said cable, for releasably attaching said cable member to a beach umbrella, second releasable attachment means, fixed to said second end of said cable, for releasably attaching said cable member to said connection means of said member, and third releasable attachment means, attached to said cable member intermediate said first and second ends, for releasably attaching said cable member to said beach umbrella.

6. The anchoring system according to claim 5, wherein said third releasable attachment means is adjustably attached to said cable member for movement along said cable member intermediate said first and second ends.

7. The anchoring system according to claim 5, wherein said first releasable attachment means is connectably engageable of a beach umbrella support shaft.

8. The anchoring system according to claim 7, wherein said third releasable attachment means is connectably engageable of said beach umbrella support shaft at a position longitudinally removed, relative to said cable member, from the position of said first releasable attachment means.

9. The anchoring system according to claim 7, wherein said first releasable attachment means comprises: a pair of straps, each of said straps being connected to said cable member, said straps being adapted to wrap around said beach umbrella support shaft; and connection means for releasably locking said straps to one another.

10. The anchoring system according to claim 9, wherein said first releasable attachment means further comprises friction means, connected to said cable member and disposed intermediate said straps and said beach umbrella support shaft when said straps are wrapped around said beach umbrella support shaft, for preventing said first releasable attachment means from sliding along said beach umbrella support shaft.

11. The anchoring system according to claim 8, wherein said third releasable attachment means comprises: a pair of straps, said pair of straps being adjustably connected to said cable member for movement along said cable member intermediate said first and second ends, said pair of straps being adapted to wrap around said beach umbrella support shaft; said connection means for releasably locking said straps to one another.

12. The anchoring system according to claim 11, wherein said third releasable attachment means further comprises friction means, adjustably connected to said cable member for movement along said cable member intermediate said first and second ends and disposed intermediate said pair of straps and said beach umbrella support shaft when said pair of straps are wrapped around said beach umbrella support shaft, for preventing said third releasable attachment means from sliding along said beach umbrella support shaft.

13. The anchoring system according to claim 5, wherein said container means comprises a substantially planar base member, having a peripheral edge; and at least one upstanding peripheral wall in contact with and attached to said peripheral edge of said base member; said base member and said at least one upstanding peripheral wall cooperating to form an open-ended container.

14. The anchoring system according to claim 13, wherein said base member is of rectangular shape.

15. The anchoring system according to claim 13, wherein said base member and said at least one upstanding peripheral wall are formed of flexible material.

16. The anchoring system according to claim 5, wherein said weighting medium is sand.

17. A beach umbrella anchor kit comprising:

(A) an anchor member comprising:

a container means for receivably containing a predetermined mass of sand, and connection means, attached to said container means, for connecting said container means to a beach umbrella restraining device;

(B) a beach umbrella restraining device comprising:

a flexible, longitudinally extending cable member, said cable member having a first end and a second end, first releasable attachment means, fixed to said first end of said cable, for releasably attaching said cable member to a beach umbrella, second releasable attachment means, fixed to said second end of said cable, for releasably attaching said cable member to said connection means of said anchor member, and third releasable attachment means, attached to said cable member intermediate said first and second ends, for releasably attaching said cable member to said beach umbrella; and (C) a sand shovel.

18. The anchor kit according to claim 17, wherein said third releasable attachment means is adjustably attached to said cable member for movement along said cable member intermediate said first and second ends.

19. The anchor kit according to claim 17, wherein said first releasable attachment means is connectably engageable of a beach umbrella support shaft.

20. The anchor kit according to claim 19, wherein said third releasable attachment means is connectably engageable of said beach umbrella support shaft at a position longitudinally removed, relative to said cable member, from the position of said first releasable attachment means.

21. The anchor kit according to claim 19, wherein said first releasable attachment means comprises: a pair of straps, each of said straps being connected to said cable member, said straps being adapted to wrap around said beach umbrella support shaft; and connection means for releasably locking said straps to one another.

22. The anchor kit according to claim 21, wherein said first releasable attachment means further comprises friction means, connected to said cable member and disposed intermediate said straps and said beach umbrella support shaft when said straps are wrapped around said beach umbrella support shaft, for preventing said first releasable attachment means from sliding along said beach umbrella support shaft.

23. The anchor kit according to claim 20, wherein said third releasable attachment means comprises: a pair of straps, said pair of straps being adjustably connected to said cable member for movement along said cable member intermediate said first and second ends, said pair of straps being adapted to wrap around said beach umbrella support shaft; said connection means for releasably locking said straps to one another.

24. The anchor kit according to claim 23, wherein said third releasable attachment means further comprises friction means, adjustably connected to said cable member for movement along said cable member intermediate said first and second ends and disposed intermediate said pair of straps and said beach umbrella support shaft when said pair of straps are wrapped around said beach umbrella support shaft, for preventing said third releasable attachment means from sliding along said beach umbrella support shaft.

25. The anchor kit according to claim 17, wherein said container means comprises a substantially planar base member, having a peripheral edge; and at least one upstanding peripheral wall in contact with and attached to said peripheral edge of said base member; said base member and said at least one upstanding peripheral wall, cooperating to form an open-ended container.

26. The anchor kit according to claim 25, wherein said base member is of rectangular shape.

27. The anchor kit according to claim 25, wherein said base member and said at least one upstanding peripheral wall are formed of flexible material.

* * * * *